US006679227B2

(12) United States Patent
Sawert et al.

(10) Patent No.: US 6,679,227 B2
(45) Date of Patent: Jan. 20, 2004

(54) GROUNDED FUEL DELIVERY MODULE FOR FUEL SYSTEM

(75) Inventors: Ulf Sawert, Grand Blanc, MI (US); Sharon Elizabeth Beyer, Grand Blanc, MI (US); Bruce Albert Kuehnemund, Flushing, MI (US)

(73) Assignee: Delphi Technologies, Inc., Troy, MI (US)

( * ) Notice: Subject to any disclaimer, the term of this patent is extended or adjusted under 35 U.S.C. 154(b) by 257 days.

(21) Appl. No.: 10/005,781

(22) Filed: Nov. 8, 2001

(65) Prior Publication Data

US 2003/0084884 A1 May 8, 2003

(51) Int. Cl.[7] ..... F02M 37/04
(52) U.S. Cl. ..... 123/509; 123/198 D; 137/571
(58) Field of Search ..... 123/509, 510, 123/198 D, 514; 137/565, 571, 574, 576, 587

(56) References Cited

U.S. PATENT DOCUMENTS

| | | | | |
|---|---|---|---|---|
| 4,318,075 A | | 3/1982 | Pudelko et al. | |
| 4,651,701 A | * | 3/1987 | Weaver | 123/509 |
| 5,642,718 A | | 7/1997 | Nakai et al. | |
| 5,647,330 A | * | 7/1997 | Sawert et al. | 123/509 |
| 5,746,088 A | | 5/1998 | Sawert et al. | |
| 5,785,032 A | | 7/1998 | Yamashita et al. | |
| 6,021,668 A | | 2/2000 | Sawert et al. | |
| 6,047,685 A | | 4/2000 | Schelhas et al. | |
| 6,168,713 B1 | | 1/2001 | Sekine et al. | |
| 6,206,035 B1 | | 3/2001 | Wehner et al. | |
| 6,216,671 B1 | | 4/2001 | Sawert et al. | |
| 6,382,190 B1 | * | 5/2002 | Tanabe et al. | 123/509 |
| 6,457,458 B1 | * | 10/2002 | Frank et al. | 123/509 |
| 2002/0124833 A1 | | 9/2002 | Fauser et al. | |

FOREIGN PATENT DOCUMENTS

| | | |
|---|---|---|
| WO | WO 00/60231 | 10/2000 |

* cited by examiner

*Primary Examiner*—Carl S. Miller
(74) *Attorney, Agent, or Firm*—Jimmy L. Funke

(57) ABSTRACT

A grounded fuel delivery module for a fuel system of a vehicle includes a fuel pump adapted to pump fuel from a fuel tank to an engine of the vehicle. The grounded fuel delivery module also includes a retainer contacting the fuel pump and a cover adapted to cover an opening in the fuel tank. The grounded fuel delivery module further includes at least one guide rod interconnecting the cover and the retainer to complete an electrical circuit used for grounding of components attached to either one of the cover and the retainer.

19 Claims, 3 Drawing Sheets

GROUNDED FUEL DELIVERY MODULE FOR FUEL SYSTEM

TECHNICAL FIELD

The present invention relates generally to fuel systems for vehicles and, more particularly, to a grounded fuel delivery module for a fuel system of a vehicle.

BACKGROUND OF THE INVENTION

It is known to provide a fuel system for a vehicle that includes a fuel delivery module disposed in a fuel tank to deliver fuel from the fuel tank to an engine of the vehicle. As the volatility of fuels has been decreased by government regulations, it has become necessary to provide a mechanism of dissipating charges which can develop in a fuel system as a result of fuel flow or movement of fuel within the fuel system under some environmental conditions. To prevent the buildup of charges similar to a capacitor, all metal or conductive plastic components in the flow of fuel must be electrically grounded to the same ground as a ground in the vehicle. Fuel lines attached to a cover of the fuel delivery module are intended to provide a ground path for these charges as they are bled off. The use of quick connect fittings in some applications may not provide a reliable ground connection. A way of providing reliability is to use a ground to an electrical ground such as that for the electrical fuel pump.

An example of an electrically grounded fuel delivery module is disclosed in U.S. Pat. No. 6,047,685 to Schelhas et al. In this patent, conductive convolute tubes are provided as an electrical ground for components through which fuel flows. These components can include the fuel filter, fuel regulator, as well as the convolute tubes themselves. Another patent, WO 200060231 uses conductive plastic material for the endcap of an electrical pump for the purpose of electrical grounding.

The fuel delivery module must be grounded for proper operation. Other manufacturers electrically ground various components such as the fuel regulator and/or fuel filter by attaching an electrical lead to these components. The electrical lead is tied into the fuel pump ground circuit. Typically, small electrical harnesses have been used, which require highly labor-intensive assembly methods or utilize expensive conductive plastics that have no fuel system exposure history.

As a result, it is desirable to provide new grounding for a fuel delivery module in a fuel system for a vehicle. It is also desirable to provide a link in an electrical circuit to ground all of the conductive or dissipative components in the fuel delivery module for a fuel system of a vehicle. It is further desirable to increase the reliability of the grounding in a fuel delivery module. Therefore, there is a need in the art to provide a grounded fuel delivery module for a fuel system that meets these desires.

SUMMARY OF THE INVENTION

It is, therefore, one object of the present invention to provide a new grounded fuel delivery module for a fuel system of a vehicle.

It is another object of the present invention to provide a grounded fuel delivery module for a fuel system of a vehicle that increases the reliability of the grounding.

To achieve the foregoing objects, the present invention is a grounded fuel delivery module for a fuel system of a vehicle including a fuel pump adapted to pump fuel from a fuel tank to an engine of the vehicle. The grounded fuel delivery module also includes a retainer contacting the fuel pump and a cover adapted to cover an opening in the fuel tank. The grounded fuel delivery module further includes at least one guide rod interconnecting the cover and the retainer to complete an electrical circuit used for grounding of components attached to either one of the cover and the retainer.

One advantage of the present invention is that a new grounded fuel delivery module is provided for a fuel system of a vehicle. Another advantage of the present invention is that the grounded fuel delivery module utilizes guide rods and a conductive pump retainer as links in an electrical circuit used to ground all of the conductive or dissipative components in the fuel delivery module. Yet another advantage of the present invention is that the grounded fuel delivery module provides a multiplicity of metallic or conductive plastic rods as part of the grounding circuit, resulting in a more positive ground circuit than strictly relying on one ground path. Still another advantage of the present invention is that the grounded fuel delivery module increases the reliability of the grounding by completing electrical circuits between all of the components, which need to be grounded, and vehicle chassis ground sources.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
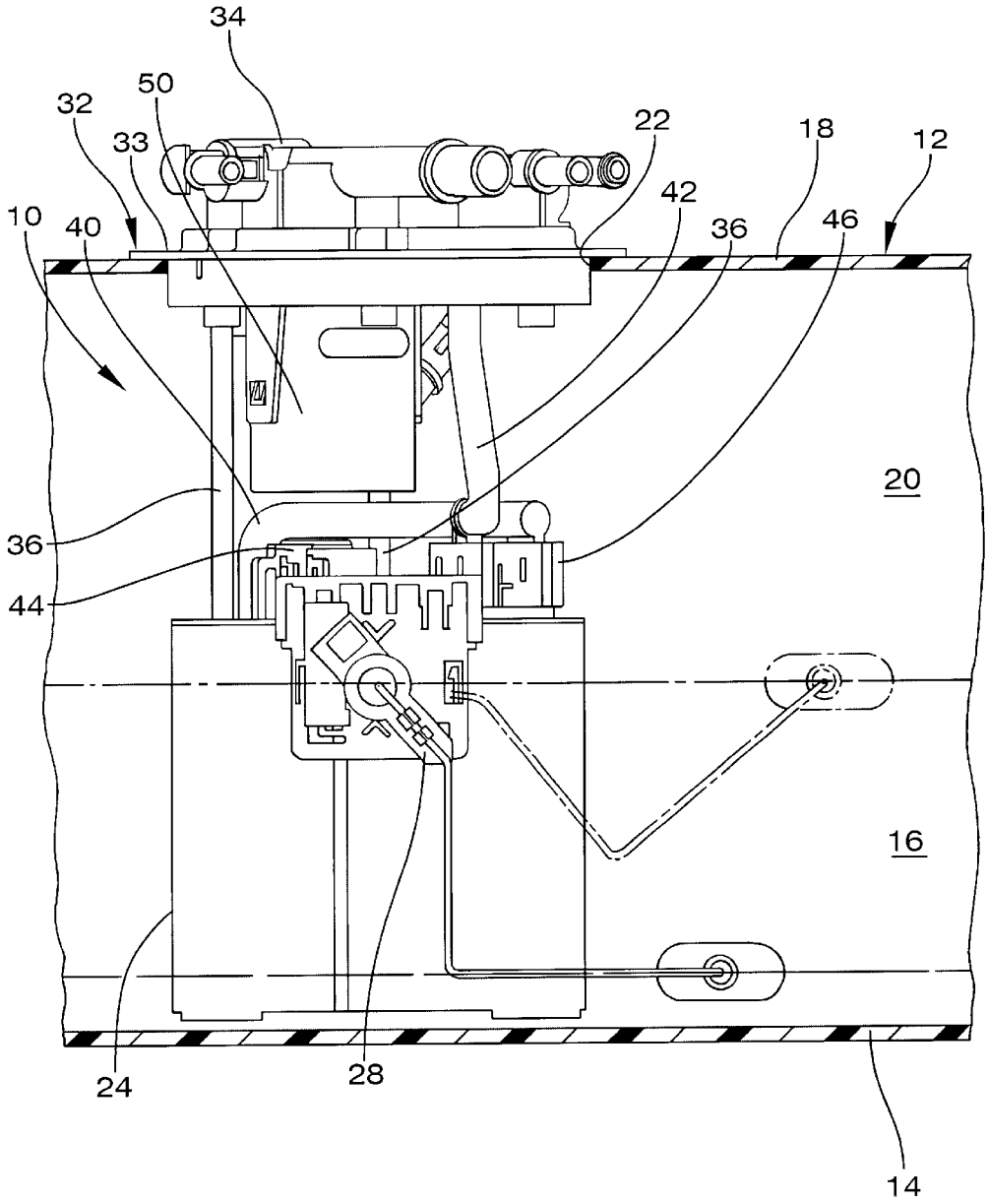
FIG. 1 is an elevational view of a grounded fuel delivery module, according to the present invention, illustrated in operational relationship with a fuel tank.

Referring to the drawings and in particular FIG. 1, one embodiment of a grounded fuel delivery module 10, according to the present invention, is shown for a fuel system (not shown) of a vehicle (not shown). The grounded fuel delivery module 10 is used with a fuel tank, generally indicated at 12, to hold liquid fuel. In this embodiment, the fuel tank 12 includes a bottom or base wall 14 and a side wall 16 around a periphery of the base wall 14 and extending generally perpendicular thereto. The fuel tank 12 also includes a top wall 18 extending generally perpendicular to the side wall 16 to form an interior chamber 20. The top wall 18 includes an opening 22 therein for a function to be described. The fuel tank 12 is made of a rigid material, preferably a plastic material. It should be appreciated that the fuel tank 12 could be made of a metal material such as steel.

Figure 2:
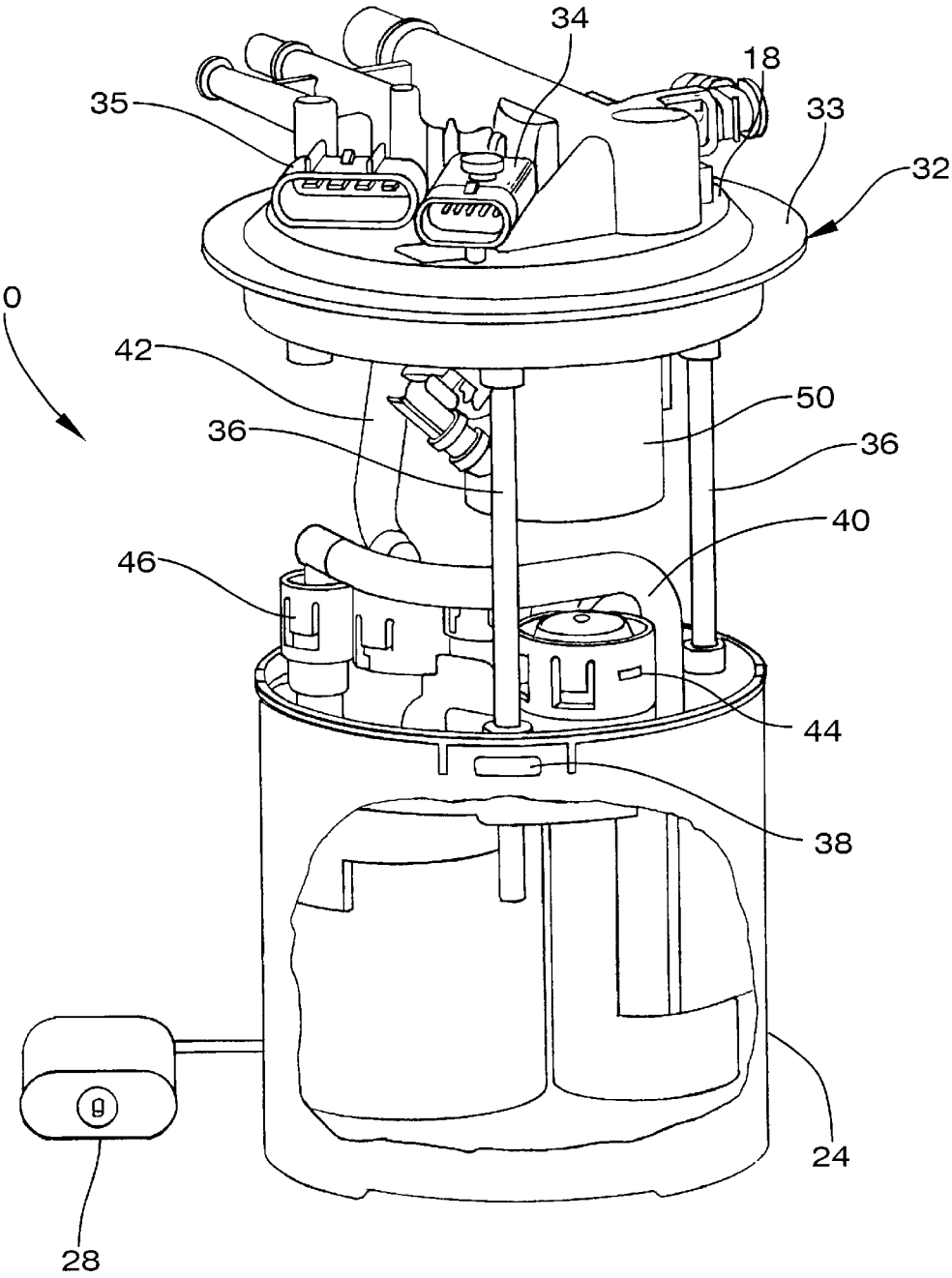
FIG. 2 is a perspective view of the ground fuel delivery module of FIG. 1.
Figure 3:
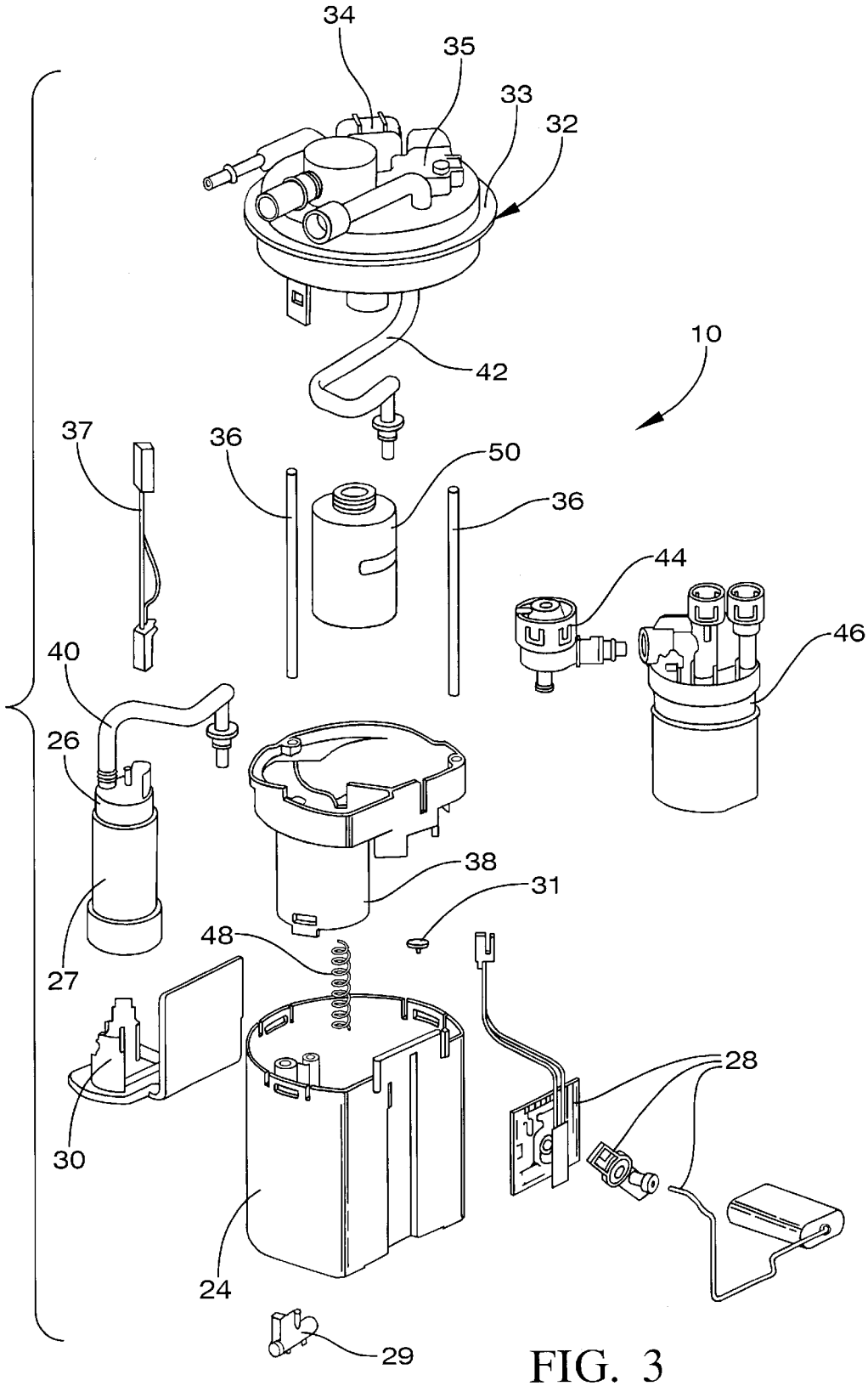
FIG. 3 is an exploded perspective view of the grounded fuel delivery module of FIG. 1.

Referring to FIGS. 1 through 3, the grounded fuel delivery module 10 is disposed in the interior chamber 20 and delivers fuel from the fuel tank 12 to an engine (not shown) of the vehicle. The grounded fuel delivery module 10 includes a fuel reservoir 24 having an electrical fuel pump 26 mounted therein. The fuel reservoir 24 is made of a non-conductive material. The fuel pump 26 has a metal shell 27 attached to an internal electrical ground therein. The grounded fuel delivery module 10 also includes a fuel level indication mechanism 28 such as a rheostat connected to the reservoir 24 for indicating the level of the fuel inside the fuel tank 12. The fuel level indication mechanism is made of a non-conductive material. The grounded fuel delivery module 10 may include a jet pump 29, pump strainer 30, and umbrella valve 31 connected to the reservoir 24. The pump strainer 30 cooperates with the fuel pump 26 and the jet pump 29 and umbrella valve 31 cooperate with the fuel reservoir 24. The jet pump 29, pump strainer 30, and umbrella valve 31 are made of a non-conductive material. It should be appreciated that the fuel reservoir 24, fuel pump 26, fuel level indication mechanism 28, jet pump 29, pump strainer 30, and umbrella valve 31 are conventional and known in the art.

The grounded fuel delivery module 10 includes a cover assembly, generally indicated at 32, to close the opening 20 in the fuel tank 12. The cover assembly 32 includes a cover 33 and an electrical connector 34 and thermistor 35 connected to the cover 33. The cover 33 is made of a metal material. It should be appreciated that the cover 33 is electrically grounded by the fuel lines (not shown) connected to the cover 33.

The grounded fuel delivery module 10 further includes a plurality of guide rods or tubes 36 to mechanically connect the cover 33 of the cover assembly 32 with the reservoir 24. The guide rods 36 are made from either a metal or conductive plastic. The grounded fuel delivery module 10 includes a pump harness 37 electrically connected to the electrical connector 34 and the fuel pump 26. It should be appreciated that the fuel pump 26 is electrically connected and grounded to a vehicle electrical system (not shown) through the pump harness 37 and the electrical connector 34.

The grounded fuel delivery module 10 includes a retainer 38 disposed in the reservoir 24 and cooperating with the fuel pump 26. The retainer 36 is made of a conductive material such as metal or a conductive plastic. The retainer 38 is in contact with the shell 27 of the fuel pump 26 and retains the fuel pump 26 within the reservoir 24. It should be appreciated that the shell 27 is electrically connected, internal to the fuel pump 26, with the ground terminal of the fuel pump 26. It should also be appreciated that the guide rods 36 complete an electrical circuit used for grounding of the components attached and electrically connected to the cover assembly 32 and the retainer 38.

The grounded fuel delivery module 10 includes other conductive/dissipative components in contact with either the cover assembly 32 or the retainer 38. The grounded fuel delivery module 10 includes at least one, preferably a plurality of convolute tubes 40 and 42 connected to the fuel pump 26 and the cover assembly 32, respectively. The convolute tubes 40 and 42 are made of a conductive material such as metal or conductive plastic. The grounded fuel delivery module 10 also includes a fuel regulator 44, fuel filter 46, and spring 48 in electrical contact with the retainer 38. The fuel regulator 44, fuel filter 46, and spring 48 are made of a conductive material such as metal or conductive plastic. The grounded fuel delivery module 10 includes a fuel limiting vent valve 50 in electrical contact with the cover assembly 32. The fuel limiting vent valve 50 is made of a non-conductive material. It should be appreciated that all components are grounded as long as there is a ground at the cover assembly 32 or through the fuel pump 26. It should also be appreciated that, by having two ground sources available, there is greater reliability in the grounding.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A grounded fuel delivery module for a fuel system of a vehicle comprising:

a fuel pump adapted to pump fuel from a fuel tank to an engine of the vehicle;

a retainer contacting said fuel pump;

a cover adapted to cover an opening in the fuel tank; and at least one guide rod interconnecting said cover and said retainer to complete an electrical circuit used for grounding of components attached to either one of said cover and said retainer.

2. A grounded fuel delivery module as set forth in claim 1 wherein said at least one guide rod is made of a conductive material.

3. A grounded fuel delivery module as set forth in claim 1 wherein said fuel pump and said cover are electrically grounded.

4. A grounded fuel delivery module as set forth in claim 1 including an electrical connector connected to said cover and adapted to be connected to an electrical system of the vehicle.

5. A grounded fuel delivery module as set forth in claim 4 including a harness electrically interconnecting said electrical connector and said fuel pump.

6. A grounded fuel delivery module as set forth in claim 1 wherein said retainer is electrically connected to a ground of said fuel pump.

7. A grounded fuel delivery module as set forth in claim 1 including at least one convolute tube made of a conductive material connected to said cover.

8. A grounded fuel delivery module as set forth in claim 1 including a regulator made of a conductive material connected to said retainer.

9. A grounded fuel delivery module as set forth in claim 1 including a fuel filter made of a conductive material connected to said retainer.

10. A grounded fuel delivery module as set forth in claim 1 wherein said retainer is made of a conductive material.

11. A grounded fuel delivery module comprising:

a fuel pump having a metal shell disposed in an interior chamber of a fuel tank to pump fuel from the fuel tank to an engine of a vehicle;

a retainer contacting said fuel pump;

a metal cover to cover an opening in the fuel tank; and a plurality of guide rods interconnecting said cover and said retainer to complete an electrical circuit used for grounding of components attached to either one of said cover and said retainer.

12. A grounded fuel delivery module as set forth in claim 11 including an electrical connector connected to said cover and adapted to be connected to an electrical system of the vehicle.

13. A grounded fuel delivery module as set forth in claim 12 including a harness electrically interconnecting said electrical connector and said fuel pump.

14. A grounded fuel delivery module as set forth in claim 11 including at least one convolute tube made of a conductive material connected to said cover.

15. A grounded fuel delivery module as set forth in claim 11 including a regulator made of a conductive material connected to said retainer.

16. A grounded fuel delivery module as set forth in claim 11 including a fuel filter made of a conductive material connected to said retainer.

17. A grounded fuel delivery module as set forth in claim 11 wherein said guide rods are made of a conductive material.

18. A grounded fuel delivery module as set forth in claim 11 wherein retainer is made of a conductive material.

19. A grounded fuel system for a vehicle comprising:

a fuel tank having an interior chamber and an opening therein;

a fuel pump having a metal shell disposed in said interior chamber of said fuel tank to pump fuel therefrom to an engine of the vehicle;

a retainer made of a conductive material contacting said metal shell of said fuel pump;

a metal cover to cover said opening in said fuel tank; and a plurality of guide rods made of either one of a metal material and a conductive plastic material interconnecting said cover and said retainer to complete an electrical circuit used for grounding of components attached to either one of said cover and said retainer.

* * * * *